United States Patent [19]

Berger

[11] Patent Number: 4,793,587

[45] Date of Patent: Dec. 27, 1988

[54] CORE FOR MOLDING HOLLOW CONCRETE BLOCKS

[76] Inventor: Leon Berger, 17459 Hesperia, Hesperia, Calif. 92345

[21] Appl. No.: 92,531

[22] Filed: Sep. 3, 1987

[51] Int. Cl.[4] ..... B28B 7/38

[52] U.S. Cl. ..... 249/63; 249/64; 249/135; 249/177; 249/66.1

[58] Field of Search ..... 249/63, 64, 66 A, 66 C, 249/144, 176, 175, 177, 135; 425/253, 461, 466, 413, 452, 456, 457, DIG. 111, DIG. 117, DIG. 118; 428/116

[56] References Cited

U.S. PATENT DOCUMENTS

| | | | |
|---|---|---|---|
| 801,249 | 10/1905 | Keagy | 249/63 X |
| 804,423 | 11/1905 | Miller | 249/64 |
| 819,055 | 5/1906 | Fisher | 249/63 X |
| 892,583 | 7/1908 | Colvin | 249/64 |
| 1,512,974 | 10/1924 | Besser et al. | 249/64 |
| 1,572,305 | 2/1926 | Nelson | 249/63 |
| 1,595,494 | 8/1926 | Barnett | 249/64 |
| 3,442,991 | 5/1969 | Lanz | 249/63 X |
| 4,300,746 | 11/1981 | Schoen | 249/144 X |
| 4,478,779 | 10/1984 | Russell et al. | 249/135 X |
| 4,653,996 | 3/1987 | Ozaki et al. | 425/461 |

FOREIGN PATENT DOCUMENTS

| | | | |
|---|---|---|---|
| 1221827 | 6/1960 | France | 249/63 |

*Primary Examiner*—Richard L. Chiesa
*Attorney, Agent, or Firm*—Julius Rubinstein

[57] ABSTRACT

A hollow core for a concrete block is cast from an abrasion resistant alloy steel known in the trade as #8620. The core is generally rectangular in cross section and includes a top wall and depending side walls. The side walls are ground to a mirror-finish and the fine tooling grooves formed when the side walls are ground are all parallel to each other and transverse to the top wall of the core. This greatly lessens the frictional resistance between the core and the cement greatly increasing the useful life of the core in comparison the cores previously constructed.

5 Claims, 2 Drawing Sheets

FIG. 1.
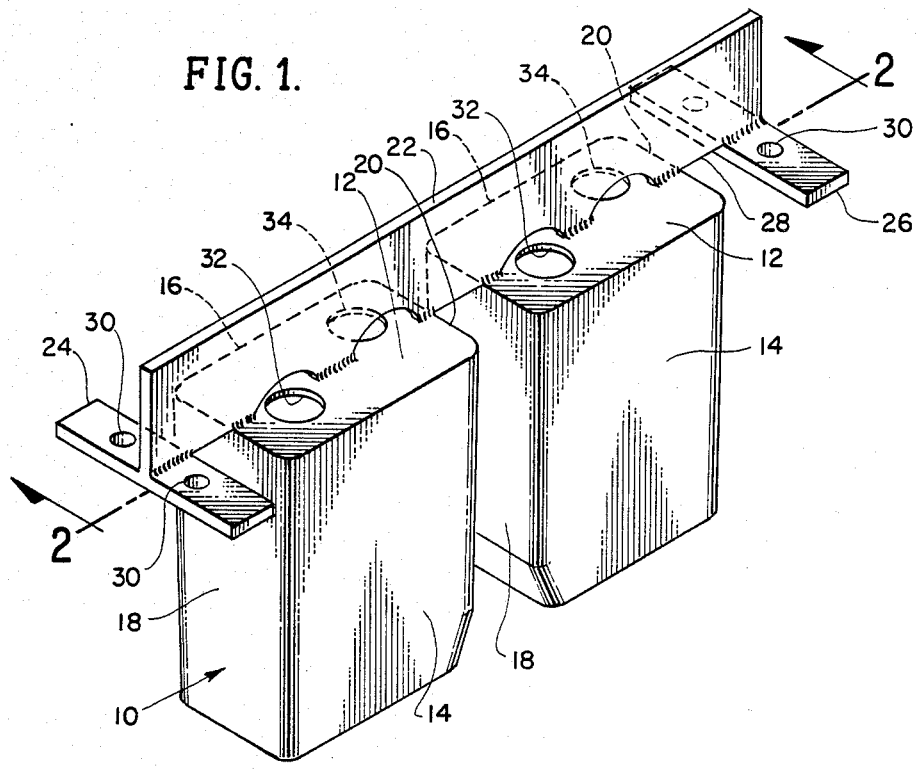
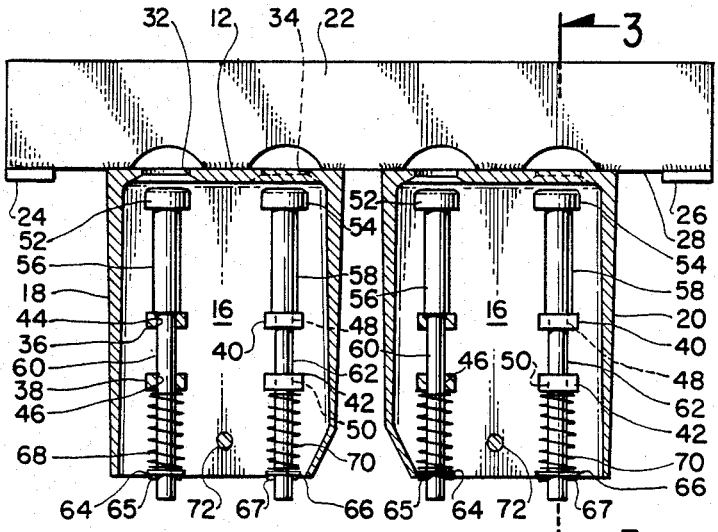
FIG. 2.
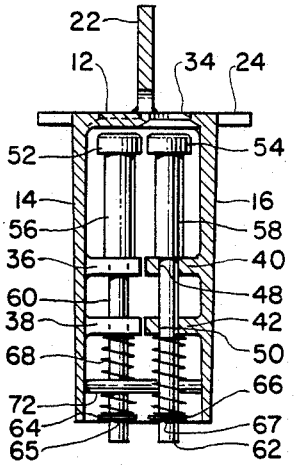
FIG. 3.
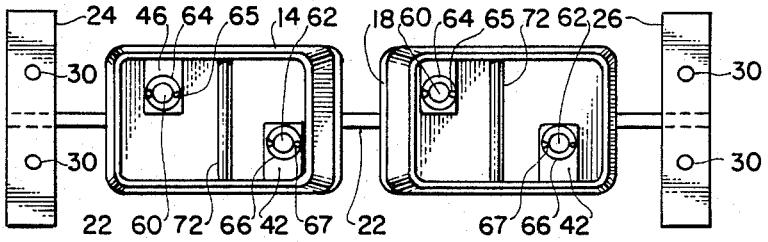
FIG. 4.

FIG. 5.
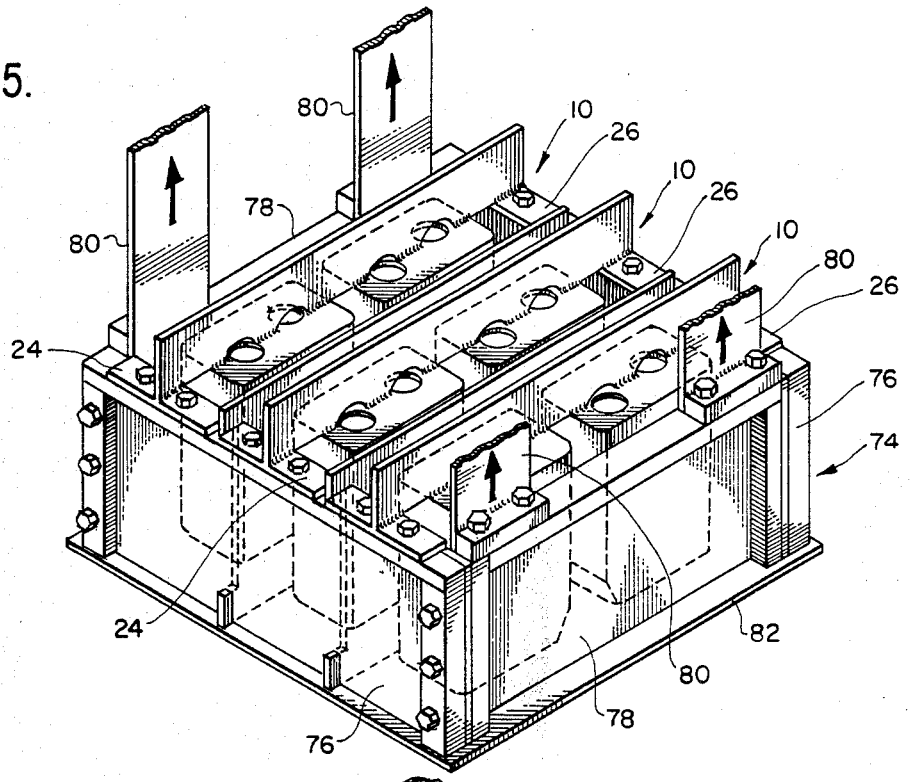
FIG. 6.
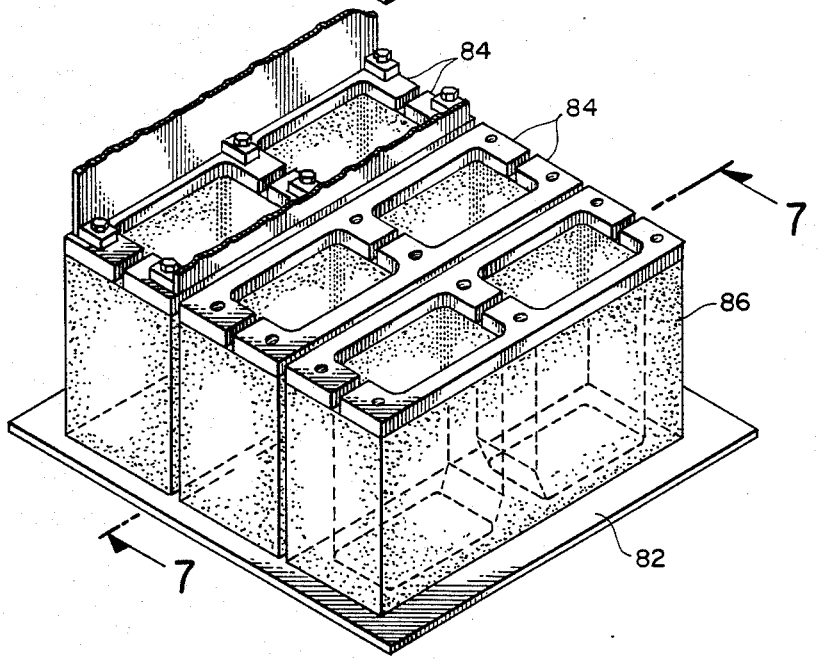
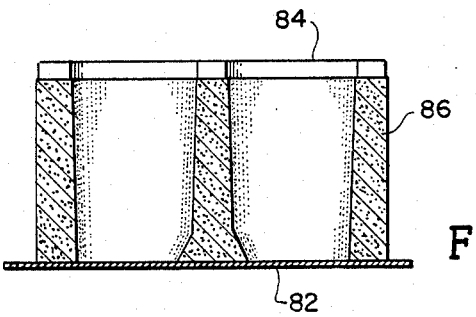
FIG. 7.

CORE FOR MOLDING HOLLOW CONCRETE BLOCKS

This invention relates to a molding device and more specifically to the core used therein for molding hollow concrete blocks.

BACKGROUND

Hollow concrete blocks are used extensively throughout the country in masonry construction of buildings due to their special characteristics. Masonry units are fireproof, durable, and long lasting. They have a high degree of compressive strength that is important when they are used to form masonry walls carrying substantial roof loads. Thus the importance of concrete blocks in the construction industry cannot be overstressed. Such demands for this particular unit of construction material has required these blocks to be manufactured in great quantities and in ever increasing speeds.

Basically, concrete blocks are made from a mixture of relatively dry concrete, aggregates, and water. They are compacted in molds typically comprising a steel box without a top or bottom and with centrally located rigidly attached cores. The mold or core box holds a number of cores and is provided with separation plates to form a corresponding number of concrete blocks. The metal cores are releasably attached to the core box so they can be easily replaced when worn after continuous use. After installation in a blockmaking machine, the core box is lowered onto a steel plate which serves as the bottom of the mold. Then the core box is filled with the concrete mixture and the core box is vibrated until the concrete is compacted enough to hold its shape. Then the core box is removed, leaving the concrete blocks resting on the steel plate. Finally the steel plate with the concrete blocks are moved onto a conveyer belt to be cured under controlled temperature and moisture conditions. This manufacturing process is repeated when another steel plate is fed into the blockmaking machine under the core box to repeat the cycle.

The speed of this operation and the forces required to lift the cores and the core box out of the concrete blocks exert great pressures on the walls of the cores, so that in the course of time after being used in the manufacture of many concrete blocks the walls of the core start to deform. This deformation causes the concrete mixture to interact with the deformations in the walls in such a way that the forces required to lift the core box and cores out of the concrete becomes greatly magnified. This in turn increases the pressure exerted by the concrete on the walls of the core so that once deformation of the walls of the core begin, the rate of deformation increases more and more rapidly. Finally the force required to lift the core box and cores out of the molded concrete blocks becomes so great that the deformed cores have to be replaced. Up to the present, this occurs when the cores have been used to manufacture between 40 to 70 thousand concrete blocks, the variation in number being dependent on the abrasiveness of the aggregates in the concrete mixture.

Heretofore, cores used in the manufacture of concrete blocks were made from steel plates. Initially two steel plates of a predetermined size and thickness were each bent so they were generally U-shaped in cross section. Each section comprised a web portion and leg flanges which were generally transverse to the web portion. The web portion (in this particular embodiment) formed the side walls of the core. The distal edges of the leg flanges on each plate were welded together to form the side walls of a generally tubular steel box which was rectangular in cross section. Then a steel plate, cut to the proper size, was welded to the ends of edges of the end walls and the side walls formed by the welded leg flanges of each plate to form the top wall of the core. However the bending of the steel plates and the welding together of the distal edges of the leg flanges of each plate introduced deformations in the surface of the core. These deformations, for the reasons described below greatly shortened the life of the core.

Valve openings were formed in the top wall and bosses were welded to the side wall. Holes were drilled through the bosses forming valve guides extending in a direction transverse to the top wall. Spring loaded valves, each including a valve stem were mounted so the valve stem was slidably mounted in the valve guides. The valves were sized to close off openings in the top wall. The length of the valve stem was such that when the cores and the core box were lowered onto a steel plate, the ends of the valve stems engaged the steel plate. This is what pushed the valve stems upward so the valves closed the openings in the top wall. This prevented the concrete mixture being poured into the core box from entering into the interior of the cores. When the core box and the core assembly were lifted off the concrete blocks, the spring loaded valves retracted from the openings, thus preventing suction from drawing the concrete into the interior of the core cavity which would deform the concrete blocks and damage the cores.

In the present state of the art, the core boxes are constructed from steel plates welded together. The welding operation causes some deformation or warping in the surface of the walls of the core. However, it was not previously realized that even small deformations in the surface of the walls of the core greatly magnify the force required to withdraw the cores out of the molded blocks and in addition greatly magnify the pressures exerted on the walls of the core. In addition it was not realized how fast the deformations in the walls of the cores grew because of the abrasiveness of the concrete, thereby shortening the useful work life of the core.

When the cores have to be replaced, the blockmaking machinery is stopped, causing a decrease in production, along with the expense of replacing the cores. It is evident that if the onset of the deformations could be delayed the useful life of the cores would be greatly prolonged.

What is needed therefore and comprises an important object of this invention is to provide a core which is formed so it is more resistant to the onset of deformations in the walls of the core thus greatly increasing the useful work life of the core.

BRIEF DESCRIPTION OF THE DRAWINGS

FIG. 1 is a perspective view of a pair of cores connected together by a mounting bar.

FIG. 2 is a sectional view taken on the line 2—2 of FIG. 1 disclosing a cross section of the core and showing the spring loaded valves inside the core.

FIG. 3 is a sectional view taken on the line 3—3 of FIG. 2.

FIG. 4 is a bottom view of the cores shown in FIG. 1.

FIG. 5 is a perspective view of a mold box showing the cores releasably but rigidly connected to the mold box.

FIG. 6 discloses the mold box shown in FIG. 1 with the cores removed and the cement blocks held in position on the steel plate by cement block retainers.

FIG. 7 discloses a sectional view taken on the line 7—7 of FIG. 6 disclosing a cross section of the cement block.

DETAILED DESCRIPTION OF THE DRAWINGS

Referring now to FIG. 1 of the drawing, a metal core cast as an integral unit and indicated generally by the reference numeral 10 comprises a top wall 12, side walls 14 and 16, and end walls 18 and 20. As shown in FIG. 1, two cores are attached together (in the particular embodiment shown) by means of a connecting bar 22 which is welded to the top wall 12 of the core. Mounting cross bars 24 and 26 are welded to the bottom edge 28 of the connecting bar 22. Bolt receiving holes 30 are typically formed in the mounting bars so that the pair of cores may be mounted on a molding machine. Valve openings 32 and 34 are formed in the upper wall 12 of the core.

A pair of bosses 36 and 38, and 40 and 42 are cast with the core and the openings 44, 46, 48, and 50 are drilled in the bosses to form the valve guides, see FIGS. 2, 3, and 4. As shown in FIG. 2 these holes are transverse to the upper wall 12.

Valves 52 and 54 are provided with depending valve stems 56 and 58 which are attached to the valves 52 and 54. Valve guides 60 and 62 are integrally formed with and concentric with the valve stems 56 and 58 and depend from the valve stems as shown in FIG. 2. Valve guide 60 extends through the holes 44 and 46 in bosses 36 and 38, while valve guide 62 extends through the holes 48 and 50 in bosses 40 and 42. With this arrangement, the valves 52 and 54 are properly aligned with the openings 32 and 34 in the top wall 12 and close off these openings when the core assembly is placed on steel plate 82.

For reasons to become apparent below, washer-like spring supports 64 and 66 are secured to the lower portion of the valve guides 60 and 62 by means of cotter pins 65 and 67, see FIGS. 2 and 4. Springs 68 and 70 are mounted on the valve guides 60 and 62 and are retained by washer-like spring supports 64 and 66 thus keeping the valves 52 and 54 retracted from the openings 32 and 34 until the core assembly with the attached mold box rests on the steel plate 82. In addition, see FIGS. 3 and 4, a side-wall bracing rod 72 cast with the core 10 is positioned at the lower end of the core, connecting the inner surface of the walls 14 and 16. This prevents the side walls 14 and 16 from flexing inward during the machine grinding process which could cause the side walls to deform.

FIG. 5 illustrates a typical relationship between the cores 10 and the mold box 74. As seen, the mold boss is formed from metal plates 76 and 78. These plates are bolted together to form the side walls of the mold box to precise internal dimensions. For reasons to become apparent below, the box has no top or bottom walls. The mounting bars 24 and 26 are bolted to the opposed side walls 76 of the mold box 74 as shown in FIG. 5. Lifting rods 80 are secured to the walls 78 of the mold box and their upper ends are connected to the lifting mechanism of block making machine (not shown). Thus the mold box 74 and the multiple cores 10 which are rigidly attached to the mold box can be lifted as a unit to clear the molded blocks so the molded blocks resting on the steel plate 82 may be moved onto a conveyer belt to the next stage of the curing process.

In the particular embodiment shown in FIG. 5, the core box 74 has three pairs of cores attached to it so that the blockmaking machine forms three concrete blocks simultaneously. However this is only for illustration. The core box could be sized to hold more pairs of cores, depending on the capacity of the blockmaking machine.

In use, with the core box 74 resting on the steel plate, the lower ends of the valve guides 60 and 62 engage the steel plate 82 and are forced upward so the valves 52 and 54 close off the valve openings 32 and 34 in the top wall 12. This is to prevent concrete being poured into the mold box from entering the interior of the core through the valve openings 32 and 34 when the level of the concrete being poured into the mold box 74 reaches the top wall 12 of the core. Next powerful machinery, not shown, shakes and compresses the concrete in the mold box in such a way that in a very short time the concrete has been compacted enough to hold its shape when the cores are removed. Next machinery, not shown, connected to the lifting plates or rods 80 attached to the mold box 74, lifts the mold box with the cores out of the concrete.

To prevent the adhesion or frictional resistance between the cores and the still wet concrete blocks from causing the concrete blocks to be lifted with the cores, the concrete blockmaking machinery includes holding plates 84 which move downwardly to the top of the concrete blocks, as shown in FIG. 6, and remain pressed against the top of the blocks until the mold box and core assembly have been withdrawn. Thereafter, the holding plates 84 are pulled away from the molded concrete blocks, while the machinery, not shown, pushes the steel plate 82 carrying the concrete blocks 86 onto a conveyer belt enabling the blockmaking machinery to move another steel plate 82 into position to receive the mold box and core assembly 74 to repeat the cycle.

During the manufacturing process, the concrete mixture adheres strongly to the walls of the core 10, requiring the machinery to exert great lifting force to disengage the mold box and cores from the raw molded concrete blocks. The machinery operates at high speed through its various cycles, thus subjecting the walls of the cores to great forces in rapid secession. These forces gradually deform the walls of the cores, and this deformation increases the frictional resistance between the walls of the core and the concrete. Consequently, as stated above, the force required to disengage the mold box and the cores from the raw concrete blocks becomes too great, so the machinery must be stopped and the deformed units removed and replaced.

As stated above it was not previously realized that even small deformations in the external surface of the side walls of the cores increased the adhesion or frictional resistance between the surface of the deformed walls of the core and the concrete, thus greatly magnifying the lifting force required to disengage the mold box and the cores from the concrete. In addition, it was not previously realized how fast the abrasiveness of the concrete mixture increased the size of the deformations in the side walls of the core during repetitive molding cycles.

To prevent the onset of the deformations in the side walls of the core, the entire core, including the openings in the top wall, the bosses in the interior of the core, and the bracing rod connected to the inner surface of the side walls, are cast as an integral unit. To further prevent the onset of deformations in the walls of the core, the core is cast from a steel such an alloy steel sold in the industry under the designation #8620, because cores cast from this metal are more abrasion resistant and thus less susceptible to the onset of deformations.

In addition, because the force exerted on the side walls is greatest near the upper portion of the side walls, the core is formed so each side wall is thickest near the top wall, tapering gradually toward the bottom portion of the side walls of the core, see FIGS. 2 and 3.

Finally, the finish of the external surfaces of the side walls of the cores is very important. In the current state of the art, the side walls are finish ground by means of hand-held grinders. This produces curved tool marks across the outer surface of the side walls of the core, thereby increasing the drag or adhesive characteristics of the core and causing the block making machinery to exert greater force on the cores when they are being withdrawn from the concrete, thereby accelerating the onset of deformations in the side walls of the core.

To prevent this from happening, and to delay the onset of deformations in the walls of the core, at least the upper fourth of the outer surfaces of the side walls are machine ground in one direction from top of the side walls toward the bottom of the side walls and ground to a mirror finish. If the direction of the grinding of the outer surface of the walls of the core was random, the grinding process itself would increase the friction between the side walls of the core and the concrete and this would accelerate the onset of the deformations in the outer surface of the side walls of the core which would greatly shorten the work life of the core.

Having described the invention, what I claim as new is:

1. A hollow core for a concrete block molding machine, said core formed entirely from a homogenous abrasive resistant steel and comprising a top wall and integrally formed side walls, said side walls having an upper portion and a lower portion, said upper portion of said side walls merging into said top wall, at least a part of the external surfaces of the upper portion of the side walls having a machine ground smooth planar mirror finish forming fine tooling grooves which are parallel to each other and transverse to the top wall of the core to lessen frictional resistance between a concrete mixture and the side walls of the core.

2. The hollow core described in claim 1 wherein the thickness of the side walls of the core is greatest adjacent the upper portion of said side walls diminishing toward the bottom portion of the side walls.

3. The hollow core described in claim 2 including valve receiving openings formed in said top wall, said side walls having interior surfaces, bosses integrally formed with said core and extending inwardly transverse to said side walls from at least some of the interior surfaces of said side walls, valve guide receiving openings formed in said bosses, the axis of said valve guide receiving openings transverse to the top wall of said core.

4. The hollow core described in claim 3 wherein the core is generally rectangular in cross section, at least one bracing rod integrally formed with said core positioned adjacent the said bottom portion of said walls and connecting the bottom portions of at least two opposed side walls together.

5. The hollow core described in claim 4 wherein the core is cast from a steel such as an alloy steel designated in the industry as #8620.

* * * * *